US007000266B2

(12) United States Patent
Piatt et al.

(10) Patent No.: US 7,000,266 B2
(45) Date of Patent: Feb. 21, 2006

(54) LAVATORY WITH A REMOVABLE WASHING PLATFORM

(75) Inventors: James M. Piatt, Sheboygan Falls, WI (US); William F. Gordon, Plymouth, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/656,742

(22) Filed: Sep. 5, 2003

(65) Prior Publication Data

US 2004/0103473 A1 Jun. 3, 2004

Related U.S. Application Data

(63) Continuation-in-part of application No. 10/116,441, filed on Apr. 4, 2002, now Pat. No. 6,631,525.

(60) Provisional application No. 60/346,003, filed on Oct. 26, 2001.

(51) Int. Cl.
*A47K 1/04* (2006.01)

(52) U.S. Cl. ..... 4/619

(58) Field of Classification Search ..... 4/619, 4/654, 656, 658
See application file for complete search history.

(56) References Cited

U.S. PATENT DOCUMENTS

| | | | | |
|---|---|---|---|---|
| 270,701 | A | 1/1883 | Scott | |
| D35,008 | S | 8/1901 | Clow | |
| 1,908,128 | A * | 5/1933 | De Bie | 4/656 |
| 2,065,347 | A | 12/1936 | Schulse | |
| 2,594,938 | A | 4/1952 | Leavitt | |
| 3,070,812 | A | 1/1963 | Skrmetta | |
| 4,305,166 | A | 12/1981 | Rose | |
| 4,689,841 | A | 9/1987 | Owen | |
| 4,698,861 | A | 10/1987 | Bogusz | |
| 5,435,022 | A | 7/1995 | Andersen | |
| 5,452,484 | A * | 9/1995 | Hill | 4/658 |
| 5,819,335 | A * | 10/1998 | Hennessy | 4/619 |
| 6,240,578 | B1 | 6/2001 | Planella | |

* cited by examiner

*Primary Examiner*—Charles E. Phillips
(74) *Attorney, Agent, or Firm*—Quarles & Brady; George E. Haas

(57) ABSTRACT

A spout directs a stream of water onto an adjacent washing apparatus. The washing apparatus has a body with a first work surface and a drain opening that is connected by a coupling to the waste water system of a building. A second platform is removably positionable on the first work surface and has a second work surface raised from the first work surface.

15 Claims, 5 Drawing Sheets

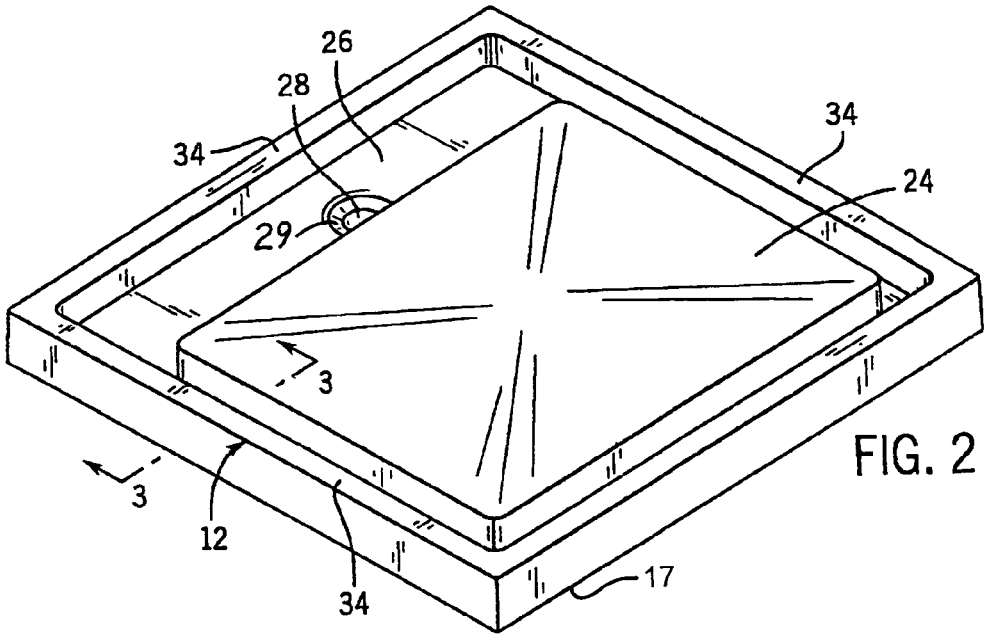
FIG. 2
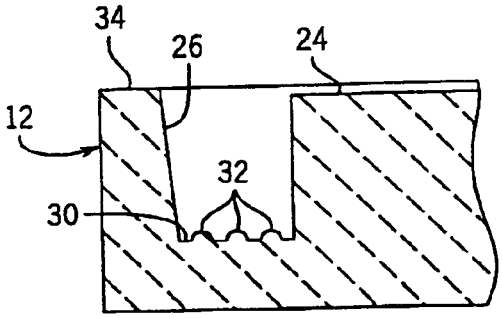
FIG. 3
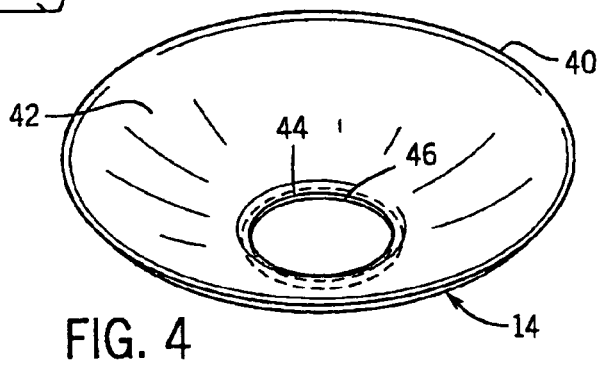
FIG. 4
FIG. 5
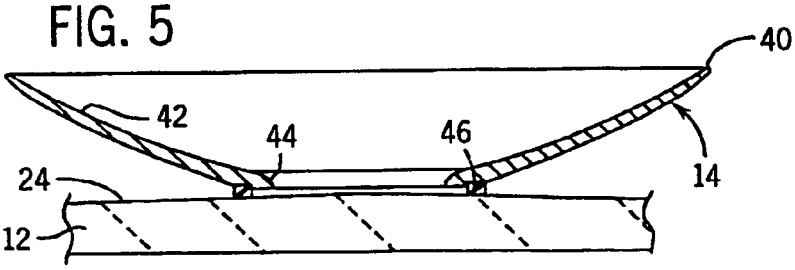

FIG. 6
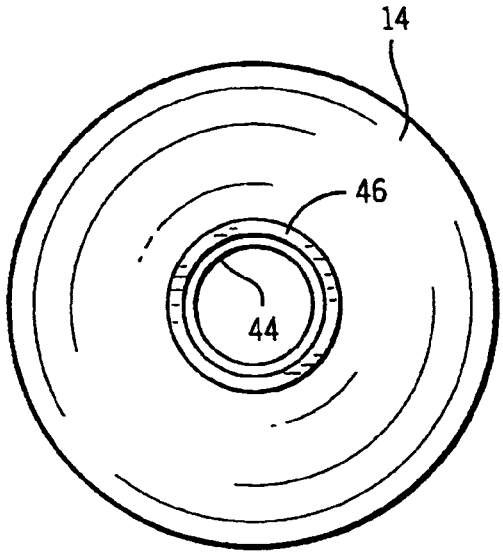
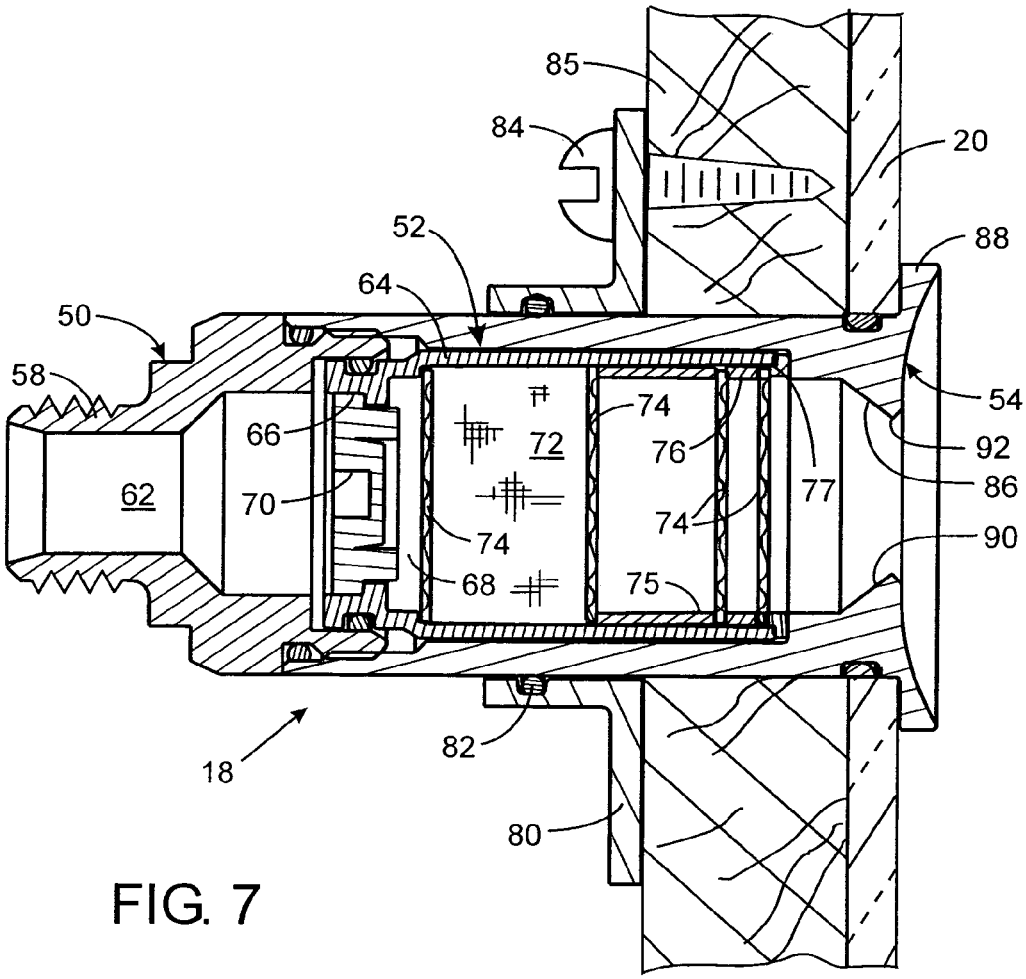
FIG. 7

FIG. 8
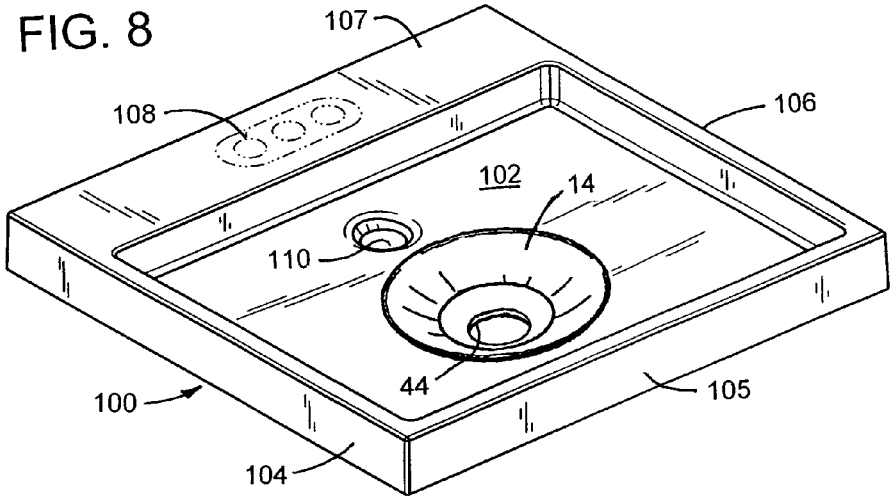
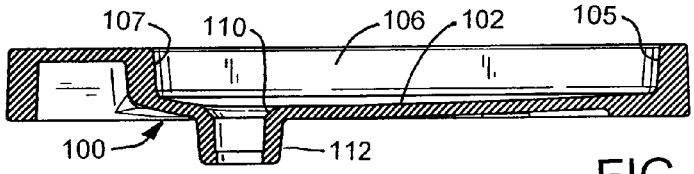
FIG. 9
FIG. 10
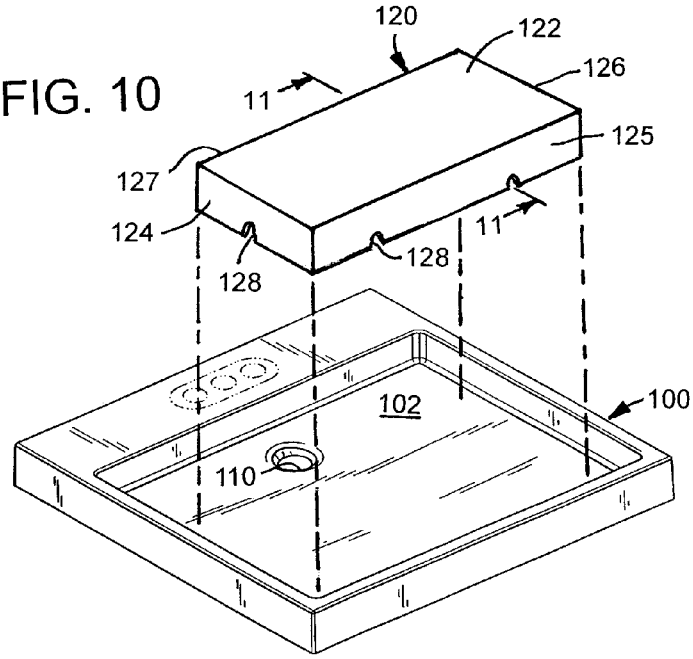
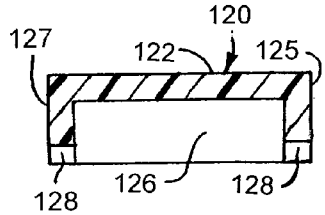
FIG. 11

LAVATORY WITH A REMOVABLE WASHING PLATFORM

CROSS-REFERENCE TO RELATED APPLICATIONS

This application is a continuation in part of U.S. patent application Ser. No. 10/116,441 filed on Apr. 4, 2002 now U.S. Pat. No. 6,631,525, which claimed benefit of U.S. Provisional Patent Application No. 60/346,003 filed Oct. 26, 2001.

STATEMENT REGARDING FEDERALLY SPONSORED RESEARCH OR DEVELOPMENT

Not Applicable

BACKGROUND OF THE INVENTION

1. Field of the Invention

The present invention relates to plumbing fixtures, and more particularly to lavatories and other washing apparatus suitable for use in bathrooms and kitchens where articles, such as hands, food or dishes, are washed.

2. Description of the Related Art

A conventional lavatory has a depressed basin with a rim wherein the basin extends downward through a hole in a counter with the rim engaging the top surface of the counter to support the lavatory. The bottom of the basin has a drain that is connected to the waste water pipe of the building in which the lavatory is located. Any one of several different types of stop mechanisms is provided to close the drain opening so that water is held within the bowl.

The lavatory typically is supplied with water from a faucet that is mounted through holes in either the lavatory rim or in the counter adjacent the lavatory. The faucet may have an aerator which mixes air with the flow of water exiting the nozzle of the faucet. The aeration produces a turbulent, non-transparent stream of water. However, in some applications it is desired that the stream from a faucet have a non-turbulent and transparent appearance, much like a clear glass rod. To provide such a stream, plumbing fixtures have been developed that produce a laminar flow of water. Laminar flow, as used herein, means fluid flow that is generally non-turbulent having essentially non-fluctuating local velocities and pressures, such that the resulting stream has a generally rod-like appearance.

To create the laminar flow, the supply water is fed through a series of flow smoothing elements before exiting via a suitable nozzle orifice. The flow smoothing elements are usually perforated disks, screens and filters which are arranged in series downstream from the supply water connection. The flow smoothing elements alter the flow velocity and redistribute the velocity profile as needed to convert turbulent flow into laminar flow.

The art has also developed kitchen sinks having a depressed basin associated with integral side work/drain areas that slope at a side to the basin.

However, there is still a need for improved washing areas, particularly in situations where counter space is scarce.

SUMMARY OF THE INVENTION

A washing apparatus includes a body that has a first work surface surrounded by an upstanding wall structure which confines fluid from flowing off the first work surface. A drain opening is located in the first work surface and a coupling is provided to link the drain opening to a building waste disposal system. A platform is removably positionable on the first work surface and has a second work surface that is raised upward from the first work surface, wherein fluid flowing off the second work surface flows onto the first work surface.

In one preferred version, the first work surface is concave thereby forming a basin for collecting and directly the fluid toward the drain opening centrally located at the bottom of the basin. When the platform is positioned on the first work surface a gap is created around and underneath the platform so that water flowing off the second work surface flows onto the concave first work surface to the drain opening.

BRIEF DESCRIPTION OF THE DRAWINGS

FIG. 2 an isometric view of the washing platform shown in FIG. 1;

FIG. 3 is a cross section through a portion of the lavatory illustrating a trough therein;

FIG. 4 is an isometric view of one of the movable lavatory bowls shown in FIG. 1;

FIG. 5 is a vertical cross sectional view through one of the bowls that is on the washing platform; and FIG. 6 is a view of the bottom of the bowl in FIG. 4;

FIG. 7 is a vertical cross-sectional view of a spout mounted on the mirror in FIG. 1;

FIG. 8 is an isometric view of a second embodiment of a washing platform with a movable lavatory bowl positioned thereon; and FIG. 9 is a cross sectional view through the second washing platform embodiment;

FIG. 10 is an exploded view of the second embodiment of the washing platform with a removable raised platform;

FIG. 11 is a cross sectional view taken along line 11—11 in FIG. 10;

DETAILED DESCRIPTION OF THE INVENTION

Figure 1:
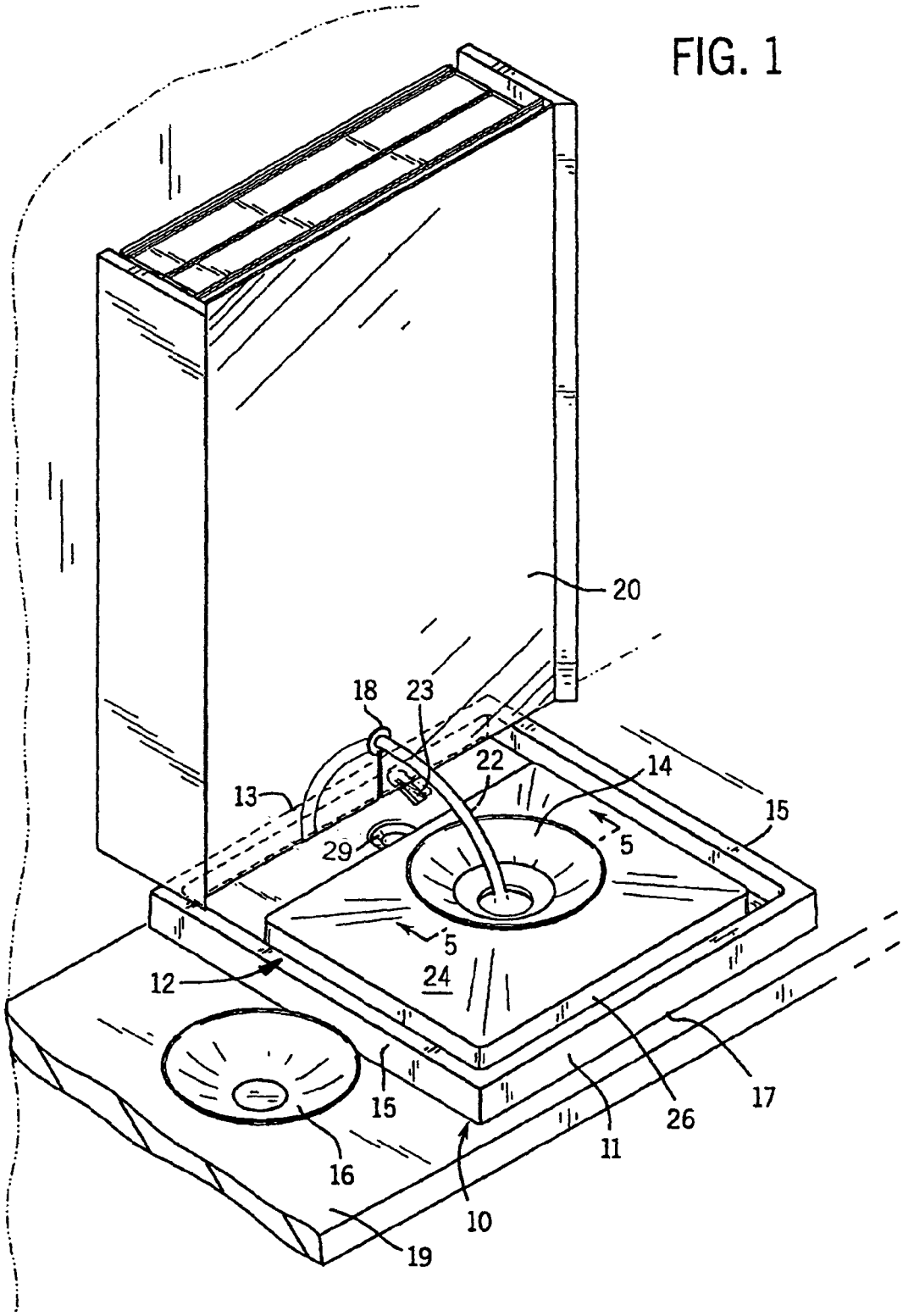
FIG. 1 is an isometric view of a washing platform and associated water spout cabinet according to the present invention.

With initial reference to FIG. 1, a washing apparatus 10 comprises a lavatory with a washing platform 12 of ceramic, polymer, cast iron or other lavatory material, and first and second bowls 14 and 16, respectively. A water spout 18, located through a mirror 20, produces a stream of water 22 that flows in an arcuate path onto the washing platform 12. The stream of water 22 is preferably emitted horizontally from the spout 18 and then curves substantially ninety degrees before striking the platform in a directly downward direction. This reduces the tendency of water to splash forward toward the user. The spout is connected to a hot and cold water supply lines by a mixing valve mounted to the mirror cabinet with the valve control lever 23 extending there from.

The washing platform 12 is generally rectilinear with front and rear walls 11 and 13, respectively, and two side walls 15. However, the platform may take the form of other geometric shapes. A bottom surface 17 of the platform 12 rests on a counter 19 and is supported thereby. The wall structure formed by the four walls 11, 13 and 15 confines fluid from flowing onto counter 19. A drain coupler 29 extends from the platform below the top of the counter 19 and can, for example, be a conventional trap used with prior lavatories.

The upper portion of the platform 12 has a central work surface 24 with edges that drop downward into a trough 26. The work surface 24 is substantially flat and horizontal. However, it is preferred that the work surface be slightly convex being crowned upward at the center and sloping downward from the center toward the trough 26, so that the water from stream 24 flows quickly to the edges of the work surface in all directions into the trough. It is further preferred that the trough 26 totally surround the work surface 24 as illustrated. In the preferred embodiment, the stream of water 22 from the water spout 18 flows in an arcuate path onto the peak of the crowned washing platform 12 so that the water flows evenly into the trough 26 on all sides.

However, alternative embodiments of the lavatory 10 can have a trough that only partially surrounds the work surface (over 270 degrees) with appropriate contouring of that work surface to direct the water into the trough. Although the term "lavatory" is being employed to refer to the preferred structure of the present invention, one skilled in the art will recognize that this inventive concept can be utilized as a kitchen work surface, a shower pan, or any other washing surface.

As shown in FIG. 2, a drain opening 28 is located in the bottom surface of the trough 26 at the rear of the lavatory. The trough 26 is sloped so that water will flow by gravity toward the drain opening 28 which is connected by coupler 29 and a standard plumbing trap (not shown) to a waste pipe for the bathroom or kitchen in which the platform is located. The rear section of the trough 26 is wider than the other sections in order to contain the volume of water flowing to the drain opening 28.

With reference to FIG. 3, the bottom surface 30 of the trough 26 can (but need not) have a plurality of ridges 32 extending along the length of each trough section. The ridges 32 slow the water flowing from the work surface 24 into the trough 26. As a consequence, the water flow is further inhibited from continuing to flow up the outer wall of the trough 26 and over the platform rim 34 onto the counter 19.

With reference to FIG. 4, the first bowl 14 has a large circular rim 40 from which an inner surface 42 slopes gradually to the bottom of the bowl interior. The center of the bowl bottom has a large circular aperture 44 extending there through. The first bowl 14 can be placed anywhere on the work surface 24 and removed there from when a bowl is not required. The first bowl 14 has an horizontal foot print of less than 100 square inches. As shown in FIGS. 5 and 6, the bottom surface of the first bowl 14 has an annular gasket 46 of resilient material (e.g. rubber) affixed thereto around the central aperture 44. When the first bowl 14 is placed on the work surface 24, as shown in FIG. 5, the gasket 46 provides a substantially water-tight seal between the bowl and the work surface. Other means may be provided to inhibit water within the bowl from flowing between the bowl and the surface of the washing platform. For example, the abutting surfaces of the bowl and the washing platform may be made very smooth to provide a tight engagement through which water does not readily flow. Those abutting surfaces also may have interlocking elements, such as a rim and a notch, to inhibit water flow.

Thus, when the stream of water 22 from the spout 18 flows into the bowl, as illustrated in FIG. 1, water will accumulate in the bowl as the gasket 46 prevents a significant amount of water from flowing out the bottom circular aperture 44. Any water that flows over the rim 40 of the first bowl will be directed by the work surface 24 into the trough 26 and through the drain opening 28.

In order to empty the first bowl 14 when the accumulated water is no longer required, the user may lift that bowl from the work surface 24 providing a gap between the gasket 46 and the work surface. This gap allows the water to flow onto the work surface, into the surrounding trough 46, and through the drain opening 28. Alternatively, the user can simply tip the bowl slightly to create such a gap. In a further draining technique, the user may simply slide the first bowl 14 across the work surface 24, so that the bottom circular aperture 44 extends over part of the trough 26. This allows the water to flow out of the bowl and into the trough.

The second bowl 16 is similar to the first bowl 14, except that it has a conventional closed bottom and does not have a circular aperture 44. This allows the second bowl 16 to be placed on the work surface 24 adjacent the spout 18 so that the water stream 22 fills the second bowl. The second bowl then can be removed from the work surface and carried to a location remote from the lavatory 12 at which a bowl of water is desired. Alternatively, both bowls 14 and 16 can be placed simultaneously on the work surface 24 with one being filled with hot water and then the other with cold water, or one with soapy water and the other with rinse water. Because the bowls do not have an integral drain outlet, the water stream from the spout 18 should be turned off once the respective bowl contains the desired quantity of water. This conserves water as compared to conventional deep basin lavatories.

The present lavatory 10 also permits the platform 12 to be utilized without either of the bowls 14 or 16. This allows the user to make full use of the entire work surface 24 for washing hands or other articles. With the bowls removed, the stream of water 22 will strike the work surface 24 and flow there across to the perimeter trough 26.

Referring to FIG. 7, the spout 18 is mounted through a hole in the surface of the mirror 20 and includes as its major components, a fixture body 50, a laminar flow cartridge 52, and a frontal nozzle 54. The fixture body 50 preferably is made of brass and has a generally tubular shape with rear coupling 58 at which a water supply line can be connected. Alternatively, the supply line coupling 58 can be transverse to the longitudinal axis of the fixture body 50. The rear end of the cylindrical laminar flow cartridge 52 is received in an open end of the cylindrical fixture body 50 and an O-ring provides a water-tight seal there between. The open end of the cylindrical fixture body 50 threads into an opening at the rear of the frontal nozzle 54 and another O-ring provides a water-tight seal between those components.

The laminar flow cartridge 52 has a cylindrical outer housing 64 with a circular rearwardly open recess 66 that communicates with a central inlet 68. A disk-shaped pressure compensating flow regulator 70, such as one commercially available from Neoperl, Inc. of Waterbury, Conn., U.S.A., is pressed into the recess 66. As water pressure in the coupling 58 increases, the regulator 70 flexes to reduce the volume of the central inlet 68. This keeps the volume of flow through the regulator relatively constant so that pressure fluctuations in the water supply line do not alter the arcuate path of the stream 22 emanating from the spout 18. Preferably, the flow regulator 70 has an operable pressure range of 12–145 PSI (0.8–10 bar).

The plastic outer housing 64 contains a series of circular or cylindrical flow smoothing members which include a filter 72 and four screens 74 separated by two ring spacers 75 and 76. The filter 72 is preferably a reticulated polyurethane foam disk having a pore size of approximately 45 pores per inch, and the screens 74 are preferably made of 20×20 stainless steel mesh. The flow smoothing members can be arranged in series in the outer housing 64 in the order shown in FIG. 7. The outer housing 64 has a large, full-width outlet opening 77 proximate the outlet of frontal nozzle 54.

The outlet end of the nozzle 54 has an outer flange 88 that abuts the mirror 20. The nozzle 54 is preferably a brass annular body with a conically shaped outlet orifice 86 that tapers inward going away from the cartridge 52. The upward ramping at point 90 of the lower portion of the orifice 86 inhibits water in the spout 18 from dripping down the mirror 20 when the water valve shuts off.

A fastening collar 80 extends around the cylindrical interior portion of the frontal nozzle 54 and abuts the wood support frame 85 behind the mirror 20. The support frame 85 and the mirror 20 are sandwiched between the fastening collar 80 and the outer flange 88 of the frontal nozzle 54. The fastening collar 80 can be slidably positioned along the cylindrical interior portion of the frontal nozzle 54 to accommodate mirrors 20 and support frames 86 of varied sizes. A plurality of wood screws 84 secure the fastening collar 80 to the support frame 86. An O-ring 82 in a notch in the inner diametric surface of the fastening collar 80 provides a friction fit with the outer surface of the frontal nozzle 54 to hold those components together while allowing adjustment as needed to secure the spout 18 to mirror structures of varying thickness.

Water from supply line coupling 58 of the spout 18 flows into the fixture body cavity 62 and then into the flow regulator 70 from which the water continues to flow into the cartridge 52 through the inlet 68. As described above, flow regulator 70 responds to fluctuations in flow rate to adjust the passable size of the inlet 68 so as to provide a relatively constant flow rate into the cartridge 52.

The flow smoothing elements (filter, screens) as well as the spacers are selected and arranged to more evenly distribute the velocity profile of the water passing through the inlet 68 throughout the entire inner diameter of the cartridge housing 64 and essentially eliminate turbulence and air pockets. Specifically, water flowing through the inlet 68 enters the larger internal chamber of the cartridge housing, which has a significantly larger diameter. This sudden expansion in cross-section is intended to reduce the flow velocity of the water. As the water passes through the pores of the filter 72, the non-axial velocity vectors (causing turbulence) are blocked by the foam material so that the water leaves the filter with the velocity vectors directed axially. As the water passes through the series of screens 74 the velocity profile is flattened so that there is a nearly uniform flow from the middle to the edges of the flow cross-section. The spacers 75 and 76 separate the screens 74 so that they operate in stages, allowing the water to recover before entering the next screen.

The water exits the spout 18 through the nozzle 54. The sharp edge 92 of the nozzle provides sufficient separation to form a single stream of water in laminar flow with little or no side spray. The emanating stream is clear and smooth, and interestingly resembles a glass rod.

With reference to FIG. 8, another lavatory, or washing platform, 100 has a generally rectangular, flat work surface 102 that is surrounded by four walls 104, 105, 106 and 107 which stand upward from the work surface. The wall structure formed by the four walls 104–107 confines fluid on the work surface 102 from flowing into the external area adjacent the lavatory 100. It should be understood that if the work surface 102 has a non-rectangular shape, a different number of walls and conceivably a single wall for an elliptical work surface would confine the fluid. The rear wall 107 may be wider than the other walls so as to accommodate apertures for receiving a conventional faucet (not shown). Alternatively the rear wall 107 may be relatively thin to be able a close relationship to the mirror 20 in FIG. 1 and receive water from water spout 18.

With additional reference to FIG. 9, the work surface 102 slants downward to an opening 110 through which fluid drains into a coupling 112. That coupling 112 is adapted for connection to a conventional waste water disposal system in a building.

Referring again to FIG. 8, the removable bowl 14, as previously described, can be placed on the work surface 102 to receive water flowing from a faucet or spout. The gasket 46 around the circular aperture 44 on the bottom surface of the bowl engages the work surface 102 to inhibit water in the bowl 14 from flowing between that bottom surface and the work surface.

FIGS. 10 and 11 depict use of a secondary washing platform 120 with the alternative lavatory 100. The removable secondary washing platform 120 resembles a box with an open bottom. As used herein the terms "removable" and "removably positioned" as used herein refer to the ability of the platform to be removed from the lavatory by a user without using tools or without affecting the ability to use the lavatory to wash articles. The secondary washing platform 120 has a generally horizontal second work surface 122 supported by four side walls 124, 125, 126 and 127 with bottom edges that rest on the first work surface 102 when in use. This secondary washing platform thus provides a work surface 122 that is raised above the first work surface 102 and which may be above the height of the side walls 124–127. It should be understood that the second work surface 122 may be supported by only two walls on opposite sides, by a plurality of legs or other support structures.

When the secondary washing platform 120 is positioned on the first work surface 102, a trough is formed around the secondary washing platform in which to receive fluids flowing from the second work surface 122. The bottom edges of the side walls 124–127 have a plurality of notches 128 which form drain apertures so that any water beneath the secondary washing platform 120 is able to flow along the first work surface 102 toward the drain opening 110. Alternatively the notches 128 may extend upward to the junction between the respective wall and a bottom surface of the second work surface 122. The width of each notch may vary from that illustrated. The second work surface 122 preferably is convex to direct fluid thereon toward the sides and onto the first work surface 102.

Figure 12:
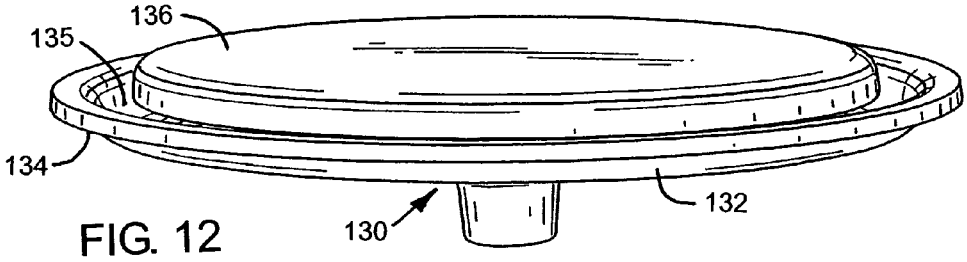
FIG. 12 is an isometric view of an embodiment of an elliptical lavatory with a removable raised platform.
Figure 13:
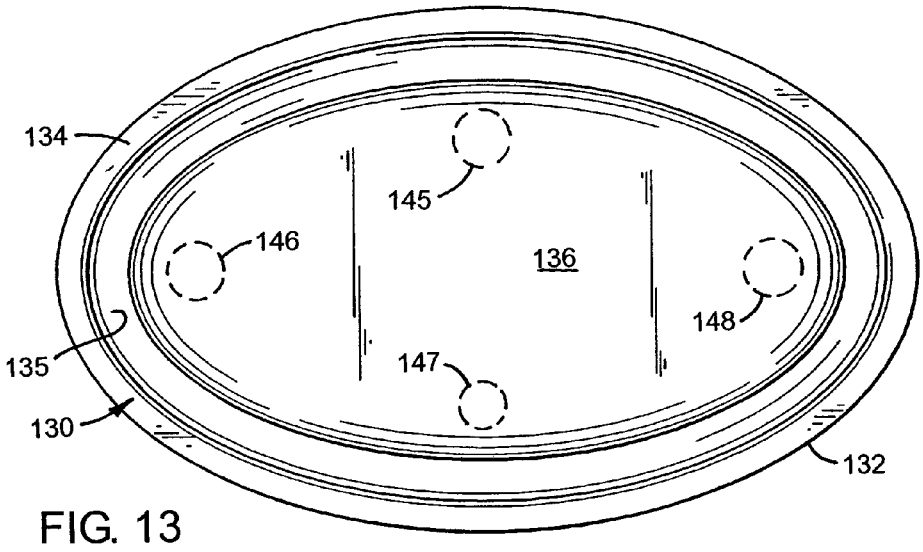
FIG. 13 is a top view of the elliptical lavatory and the removable raised platform.

With reference to FIGS. 12 and 13, a third embodiment of a lavatory 130 according to the present invention has concave basin 132 with an elliptical perimeter from which an annular rim 134 projects. The rim 134 rests on a counter top or other surface on which the lavatory is installed. The lavatory 130 can be substituted for the washing platform 12 shown in FIG. 1 to receive water flowing from the spout 18. A removable platform 136 has a similar elliptical shape conforming generally to the shape of the basin 132, but being slightly smaller so as to fit within the basin.

Figure 14:
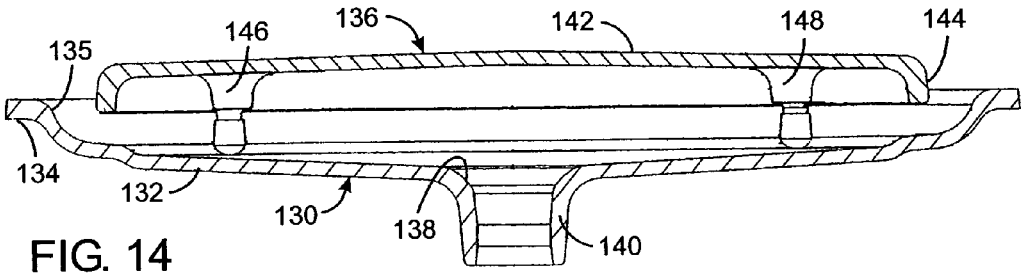
FIG. 14 is a cross sectional view of the elliptical lavatory and the removable raised platform.

With particular reference to FIG. 14, the basin 132 has a concave first work surface 135 which curves downward toward a central drain opening 138. The drain opening 138 leads into a tubular coupling 140 adapted for connection to the waste disposal pipes of the building in which the lavatory 130 is located.

The removable platform 136 has a second work surface 142. An annular lip 144 extends around the second work surface 142 projecting downward toward the basin 132 when the platform is positioned therein. The second work surface 142 is convex, in other words crowned at the midpoint, so that water flowing thereon from a spout is directed toward perimeter and into the basin 132. Four legs 145, 146, 147, and 148 project downward from the underside of the second work surface 142 with a pair of legs located on each of the major and minor axes of the elliptical platform 136. Only two of the legs 146 and 148, which are located along the major axis of the platform, are visible in FIG. 14. The plurality of legs 145–148 support the second work surface 142 in a raised position from the first work surface 135, above rim 134 thereby forming a gap between those work surfaces which allows water to flow off the second work surface onto and along the first work surface toward the drain opening 138. A user is able to lift the platform 136 from the first work surface 135, thereby creating a conventional lavatory basin, as desired.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

INDUSTRIAL APPLICABILITY

The present invention provides washing platforms useful for cleaning hands, faces and articles and, for example, may be employed as a lavatory or a kitchen sink.

We claim:

1. A washing apparatus comprising:

a body including an first work surface with first perimeter having an elliptical shape and surrounded by an upstanding wall structure which confines fluid from flowing off the first work surface at said perimeter, and having a drain opening in the first work surface;

a coupling suitable to link the drain opening to a building waste disposal system; and a platform that during washing use is both movably positioned on the first work surface and unfastened to the body, the platform having a second work surface with an second perimeter having an elliptical shape, said second work surface being raised upward from the first work surface so as to be located above said upstanding wall structure when said platform is positioned on said first work surface, wherein fluid flows unimpeded off the second perimeter of the second work surface onto the first work surface.

2. The washing apparatus as recited in claim 1 wherein the first work surface is concave.

3. The washing apparatus as recited in claim 1 wherein the platform further comprises a plurality of supports which raise the second work surface from the first work surface.

4. The washing apparatus as recited in claim 1 wherein the platform further comprises a plurality of legs which raise the second work surface from the first work surface.

5. The washing apparatus as recited in claim 1 wherein the second work surface is convex thereby directing water onto the first work surface.

6. The washing apparatus as recited in claim 1 further comprising a spout which emits a stream of water onto the first work surface.

7. The washing apparatus as recited in claim 6 wherein the spout emits a laminar stream of water onto the first work surface.

8. The washing apparatus as recited in claim 1 further comprising a bowl for retaining fluid and a bowl being removably positionable on the second work surface, the bowl having a bottom portion with an aperture there through and an exterior lower surface having a sealing means which extends around the aperture to engage the second work surface to inhibit flow of fluid outward from the bowl.

9. The washing apparatus as recited in claim 8 wherein the sealing means comprises a gasket attached to the exterior lower surface of the bowl.

10. A plumbing fixture for washing objects comprising:

a body including a first work surface with a first perimeter having a geometric shape and surrounded by a structure that prevents a fluid from flowing outward from the first work surface and off the plumbing fixture; and having a drain opening to receive the fluid flowing from the first work surface;

a coupling suitable to link the drain opening to a building waste disposal system; and a platform that during washing use is both movably positioned on the first work surface and unfastened to the body, the platform having a second work surface with a second perimeter having a like geometric shape as the first perimeter and raised upward from the first work surface so as to be located above said structure when said platform is positioned on said first work surface, wherein fluid flows unimpeded off the perimeter of the second work surface and into the drain opening of the body.

11. The plumbing fixture as recited in claim 10 wherein the first work surface and the second work surface have elliptical first and second perimeters.

12. The plumbing fixture as recited in claim 11 wherein the platform further comprises a plurality of legs which raise the second work surface from the first work surface.

13. The plumbing fixture as recited in claim 10 wherein the platform further comprises a plurality of legs which raise the second work surface from the first work surface.

14. The plumbing fixture as recited in claim 10 wherein the second work surface has a rectangular perimeter and fluid flows unimpeded off four edges of the rectangular perimeter onto the first work surface.

15. The washing apparatus as recited in claim 10 wherein the second work surface has a crown at a center and slopes downward from the center toward the second perimeter thereby directing water onto the first work surface.

* * * * *